US008331591B2

(12) United States Patent
Fischer et al.

(10) Patent No.: US 8,331,591 B2
(45) Date of Patent: Dec. 11, 2012

(54) HEARING AID AND METHOD FOR OPERATING A HEARING AID

(75) Inventors: Eghart Fischer, Schwabach (DE); Matthias Fröhlich, Erlangen (DE); Jens Hain, Kleinsendelbach (DE); Henning Puder, Erlangen (DE); Andre Steinbuss, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 825 days.

(21) Appl. No.: 12/311,631

(22) PCT Filed: Oct. 8, 2007

(86) PCT No.: PCT/EP2007/060652

§ 371 (c)(1),
(2), (4) Date: Apr. 7, 2009

(87) PCT Pub. No.: WO2008/043731

PCT Pub. Date: Apr. 17, 2008

(65) Prior Publication Data

US 2010/0034406 A1 Feb. 11, 2010

(30) Foreign Application Priority Data

Oct. 10, 2006 (DE) ..... 10 2006 047 987

(51) Int. Cl.
*H04R 25/00* (2006.01)

(52) U.S. Cl. ..... 381/313; 381/23.1; 381/312; 381/317

(58) Field of Classification Search ..... 381/312, 381/313, 314, 316, 317

See application file for complete search history.

(56) References Cited

U.S. PATENT DOCUMENTS

| | | | | |
|---|---|---|---|---|
| 6,430,528 | B1 | 8/2002 | Jourjine et al. | |
| 6,947,570 | B2 * | 9/2005 | Maisano | 381/313 |
| 2005/0265563 | A1 | 12/2005 | Maisano | |
| 2007/0257840 | A1 * | 11/2007 | Wang et al. | 342/383 |

FOREIGN PATENT DOCUMENTS

| | | | |
|---|---|---|---|
| EP | 1017253 | A2 | 7/2000 |
| EP | 1463378 | A2 | 9/2004 |
| EP | 1655998 | A2 | 5/2006 |
| EP | 1670285 | A2 | 6/2006 |
| JP | 9033329 | A | 2/1997 |
| JP | 2000066698 | A | 3/2000 |
| WO | WO 0187011 | A2 | 11/2001 |
| WO | 2008043731 | A1 | 4/2008 |

OTHER PUBLICATIONS

Communication from Japanese Patent Office stating cited reference, Dec. 22, 2011, pp. 1-8.

* cited by examiner

*Primary Examiner* — Calvin Lee
*Assistant Examiner* — Scott Stowe

(57) ABSTRACT

The invention relates to a method for operating a hearing aid. A local source operating mode is established by a signal processing section of the hearing aid for tracking and selecting a local acoustic source of an ambient sound. Electrical acoustic signals from which the local acoustic source is determined by the signal processing section are generated by the hearing aid from the detected ambient sound. The local acoustic source is selectively taken into account by the signal processing section in an output sound of the hearing aid such that the local acoustic source is at least acoustically prominent and is therefore better perceived compared to another acoustic source for a hearing aid wearer.

19 Claims, 3 Drawing Sheets

HEARING AID AND METHOD FOR OPERATING A HEARING AID

CROSS REFERENCE TO RELATED APPLICATIONS

This application is the US National Stage of International Application No. PCT/EP2007/060652, filed Oct. 8, 2007 and claims the benefit thereof. The International Application claims the benefits of German application No. 10 2006 047 987.4 filed Oct. 10, 2006, both of the applications are incorporated by reference herein in their entirety.

FIELD OF THE INVENTION

The invention relates to a method for operating a hearing aid consisting of a single hearing device or two hearing devices. The invention also relates to a corresponding hearing aid or hearing device.

BACKGROUND OF THE INVENTION

When one is listening to someone or something, disturbing noise or unwanted acoustic signals are present everywhere that interfere with the other person's voice or with a wanted acoustic signal. People with a hearing impairment are especially susceptible to such noise interference. Background conversations, acoustic disturbance from digital devices (cell phones), traffic or other environmental noise can make it very difficult for a hearing-impaired person to understand the speaker they want to listen to. Reducing the noise level in an acoustic signal, combined with automatic focusing on a wanted acoustic signal component, can significantly improve the efficiency of an electronic speech processor of the type used in modern hearing aids.

Hearing aids employing digital signal processing have recently been introduced. They contain one or more microphones, A/D converters, digital signal processors, and loudspeakers. The digital signal processors usually subdivide the incoming signals into a plurality of frequency bands. Within each of these bands, signal amplification and processing can be individually matched to the requirements of a particular hearing aid wearer in order to improve the intelligibility of a particular component. Also available in connection with digital signal processing are algorithms for minimizing feedback and interference noise, although these have significant disadvantages. The disadvantageous feature of the algorithms currently employed for minimizing interference noise is, for example, the maximum improvement they can achieve in hearing-aid acoustics when speech and background noise are within the same frequency region, making them incapable of distinguishing between spoken language and background noise. (See also EP 1 017 253 A2).

This is one of the most frequently occurring problems in acoustic signal processing, namely extracting one or more acoustic signals from different overlapping acoustic signals. It is also known as the "cocktail party problem", wherein all manner of different sounds such as music and conversations merge into an indefinable acoustic backdrop. Nevertheless, people generally do not find it difficult to hold a conversation in such a situation. It is therefore desirable for hearing aid wearers to be able to converse in just such situations in the same way as people without a hearing impairment.

In acoustic signal processing there exist spatial (e.g. directional microphone, beam forming), statistical (e.g. blind source separation), and hybrid methods which, by means of algorithms and otherwise, are able to separate out one or more sound sources from a plurality of simultaneously active sound sources. For example, by means of statistical signal processing of at least two microphone signals, blind source separation enables source signals to be separated without prior knowledge of their geometric arrangement. When applied to hearing aids, that method has advantages over conventional approaches involving a directional microphone. Using a BSS (Blind Source Separation) method of this kind it is inherently possible, with n microphones, to separate up to n sources, i.e. to generate n output signals.

Known from the relevant literature are blind source separation methods wherein sound sources are analyzed by analyzing at least two microphone signals. A method and corresponding device of this kind are known from EP 1 017 253 A2, the scope of whose disclosure is expressly to be included in the present specification. Corresponding points of linkage between the invention and EP 1 017 253 A2 are indicated mainly at the end of the present specification.

In a specific application for blind source separation in hearing aids, this requires communication between two hearing devices (analysis of at least two microphone signals (right/left)) and preferably binaural evaluation of the signals of the two hearing devices which is preferably performed wirelessly. Alternative couplings of the two hearing devices are also possible in such an application. Binaural evaluation of this kind with stereo signals being provided for a hearing aid wearer is taught in EP 1 655 998 A2, the scope of whose disclosure is likewise to be included in the present specification. Corresponding points of linkage between the invention and EP 1 655 998 A2 are indicated at the end of the present specification.

Directional microphone control in the context of blind source separation is subject to ambiguity once a plurality of competing wanted sources, e.g. speakers, are simultaneously present. While blind source separation basically allows the different sources to be separated, provided they are spatially separate, the potential benefit of a directional microphone is reduced by said ambiguity problems, although a directional microphone can be of great benefit in improving speech intelligibility specifically in such scenarios.

The hearing aid or more specifically the mathematical algorithms for blind source separation is/are basically faced with the dilemma of having to decide which of the signals produced by blind source separation can be most advantageously forwarded to the algorithm user, i.e. the hearing aid wearer. This is basically an unresolvable problem for the hearing aid because the choice of wanted acoustic source will depend directly on the hearing aid wearer's momentary intention and hence cannot be available to a selection algorithm as an input variable. The choice made by said algorithm must accordingly be based on assumptions about the listener's likely intention.

The prior art is based on the assumption that the hearing aid wearer prefers an acoustic signal from a 0° direction, i.e. from the direction in which the hearing aid wearer is looking. This is realistic insofar as, in an acoustically difficult situation, the hearing aid wearer would look at his/her current interlocutor to obtain further cues (e.g. lip movements) for increasing said interlocutor's speech intelligibility. This means that the hearing aid wearer is compelled to look at his/her interlocutor so that the directional microphone will produce increased speech intelligibility. This is annoying particularly when the hearing aid wearer wants to converse with just one person, i.e. is not involved in communicating with a plurality of speakers, and does not always wish/have to look at his/her interlocutor.

However, the conventional assumption that the hearing aid wearer's wanted acoustic source is in his/her 0° viewing direction is incorrect for many cases; namely, for example, for the case that the hearing aid wearer is standing or sitting next to his/her interlocutor and other people, e.g. at the same table, are holding a shared conversation with him/her. With a preset acoustic source in 0° viewing direction, the hearing aid wearer would constantly have to turn his/her head from side to side in order to follow his/her conversation partners.

Furthermore, there is to date no known technical method for making a "correct" choice of acoustic source, or more specifically one preferred by the hearing aid wearer, after source separation has taken place.

SUMMARY OF THE INVENTION

On the assumption that, in a communication situation, e.g. sitting at a table, a person in a 0° viewing direction of a hearing aid wearer is not continually the preferred acoustic source, a more flexible acoustic signal selection method can be formulated that is not limited by a geometric acoustic source distribution. An object of the invention is therefore to specify an improved method for operating a hearing aid, and an improved hearing aid. In particular, it is an object of the invention to determine which output signal resulting from source separation, in particular blind source separation, is acoustically fed to the hearing aid wearer. It is therefore an object of the invention to discover which source is, with a high degree of probability, a preferred acoustic source for the hearing aid wearer.

A choice of wanted acoustic source is inventively made such that the wanted speaker, i.e. the wanted acoustic source, is always the one whose distance from a microphone (system) of the hearing aid is preferably the shortest of all the distances of the detected speakers, i.e. acoustic sources. This also inventively applies to a plurality of speakers or acoustic sources whose distances from the microphone (system) are short compared to other speakers or acoustic sources.

A method for operating a hearing aid is inventively provided wherein, for tracking and selectively amplifying an acoustic source, a signal processing section of the hearing aid determines a distance from the acoustic source to the hearing aid wearer for preferably all the electrical acoustic signals available to said hearing aid wearer and assigns it to the corresponding acoustic signal. The acoustic source or sources with short or the shortest distances with respect to the hearing aid wearer are tracked by the signal processing section and particularly taken into account in the hearing aid's acoustic output signal.

In addition, a hearing aid is inventively provided wherein a distance of an acoustic source from the hearing aid wearer can be determined by an acoustic module (signal processing section) of the hearing aid and can then be assigned to electrical acoustic signals. The acoustic module then selects at least one electrical acoustic signal, said signal representing a short spatial distance from the assigned acoustic source to the hearing aid wearer. This electrical acoustic signal can be taken into account in particular in the hearing aid's output sound.

The electrical acoustic signals are analyzed by the hearing aid in particular for features which—individually or in combination—are indicative of the distance from the acoustic source to the microphone (system) or the hearing aid wearer. This preferably takes place after applying a blind source separation algorithm.

It is inventively possible, depending on the number of microphones in the hearing aid, to select one or more (speech) acoustic sources present in the ambient sound and emphasize it/them in the hearing aid's output sound, it being possible to flexibly adjust a volume of the acoustic source or sources in the hearing aid's output sound.

In a preferred embodiment of the invention, the signal processing section has an unmixer module that preferably operates as a blind source separation device for separating the acoustic sources within the ambient sound. The signal processing section also has a post-processor module which, when an acoustic source is detected in the vicinity (local acoustic source), sets up a corresponding "local source" operating mode in the hearing aid. The signal processing section can also have a pre-processor module—the electrical output signals of which are the unmixer module's electrical input signals—which standardizes and conditions electrical acoustic signals originating from microphones of the hearing aid. In respect of the pre-processor module and unmixer module, reference is made to EP 1 017 253 A2 paragraphs [0008] to [0023].

In a preferred embodiment of the invention, the hearing aid or more specifically the signal processing section or more specifically the post-processor module performs distance analysis of the electrical acoustic signals to the effect that, for each of the electrical acoustic signals, a distance of the corresponding acoustic source from the hearing aid is simultaneously determined and then mainly the electrical acoustic signal or signals with a short source distance are output by the signal processing section or more specifically the post-processor module to a hearing aid receiver or more specifically loudspeaker which converts the electrical acoustic signals into analog sound information.

Preferred acoustic sources are speech or more specifically speaker sources, the probability of automatically selecting the "correct" speech or more specifically speaker source, i.e. the one currently wanted by the hearing aid wearer, being increased—at least for many conversation situations—by selecting the speaker with the shortest horizontal distance from the hearing aid wearer's ear.

According to the invention, the electrical acoustic signals to be processed in the hearing aid, in particular the electrical acoustic signals separated by source separation, are examined for information contained therein that is indicative of a distance of the acoustic source from the hearing aid wearer. It is possible to differentiate here between a horizontal distance and a vertical distance, an excessively large vertical distance representing a non-preferred source. The items of distance information contained in an individual electrical acoustic signal are processed individually or plurally or in their respective totality to the effect that a spatial distance of the acoustic source represented thereby can be determined.

In a preferred embodiment of the invention it is advantageous if the corresponding electrical acoustic signal is examined to ascertain whether it contains spoken language, it being particularly advantageous here if it is a known speaker, i.e. a speaker known to the hearing aid, the speech profile of which has been stored with corresponding parameters inside the hearing aid.

Additional preferred embodiments of the invention will emerge from the other dependent claims.

BRIEF DESCRIPTION OF THE DRAWINGS

The invention will now be explained in greater detail with the aid of exemplary embodiments and with reference to the accompanying drawings in which.

DETAILED DESCRIPTION OF THE INVENTION

Within the scope of the invention (FIGS. 2 & 3), the following description mainly relates to a BSS (blind source separation) module. However, the invention is not limited to blind source separation of this kind but is intended broadly to encompass source separation methods for acoustic signals in general. Said BSS module is therefore also referred to as an unmixer module.

The following description also discusses "tracking" of an electrical acoustic signal by a hearing aid wearer's hearing aid. This is to be understood in the sense of a selection made by a hearing aid, or more specifically by a signal processing section of the hearing aid, or more specifically by a post-processor module of the signal processing section, of one or more electrical speech signals that are electrically or electronically selected by the hearing aid from other acoustic sources in the ambient sound and which are reproduced in an amplified manner compared to the other acoustic sources in the ambient sound, i.e. in a manner experienced as louder for the hearing aid wearer. Preferably, no account is taken by the hearing aid of a position of the hearing aid wearer in space, in particular a position of the hearing aid in space, i.e. a direction in which the hearing aid wearer is looking, while the electrical acoustic signal is being tracked.

Figure 1:
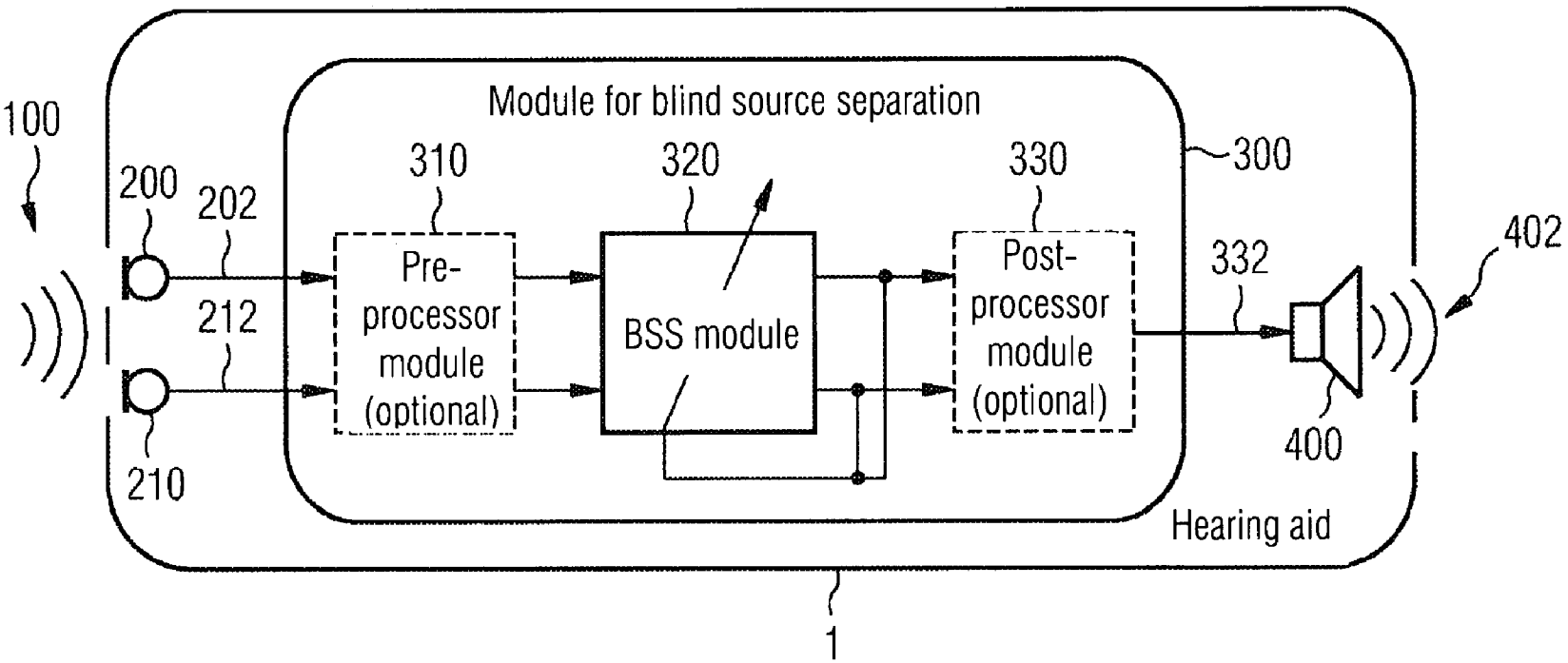
FIG 1 Prior art
FIG. 1 shows a block diagram of a hearing aid according to the prior art, having a module for blind source separation.

FIG. 1 shows the prior art as taught in EP 1 017 253 A2 (as to which see paragraph et seq.). Here a hearing aid 1 has two microphones 200, 210, which can together constitute a directional microphone system, for generating two electrical acoustic signals 202, 212. A microphone arrangement of this kind gives the two electrical output signals 202, 212 of the microphones 200, 210 an inherent directional characteristic. Each of the microphones 200, 210 picks up an ambient sound 100 which is a mixture of unknown acoustic signals from an unknown number of acoustic sources.

In the prior art, the electrical acoustic signals 202, 212 are mainly conditioned in three stages. In a first stage, the electrical acoustic signals 202, 212 are pre-processed in a pre-processor module 310 to improve the directional characteristic, starting with standardizing the original signals (equalizing the signal strength). In a second stage, blind source separation takes place in a BSS module 320, the output signals of the pre-processor module 310 undergoing an unmixing process. The output signals of the BSS module 320 are then post-processed in a post-processor module 330 in order to generate a desired electrical output signal 332 which is used as an input signal for a receiver 400, or more specifically a loudspeaker 400 of the hearing aid 1 and to deliver a sound generated thereby to the hearing aid wearer. According to the specification in EP 1 017 253 A2, steps 1 and 3, i.e. the pre-processor module 310 and post-processor module 330, are optional.

Figure 2:
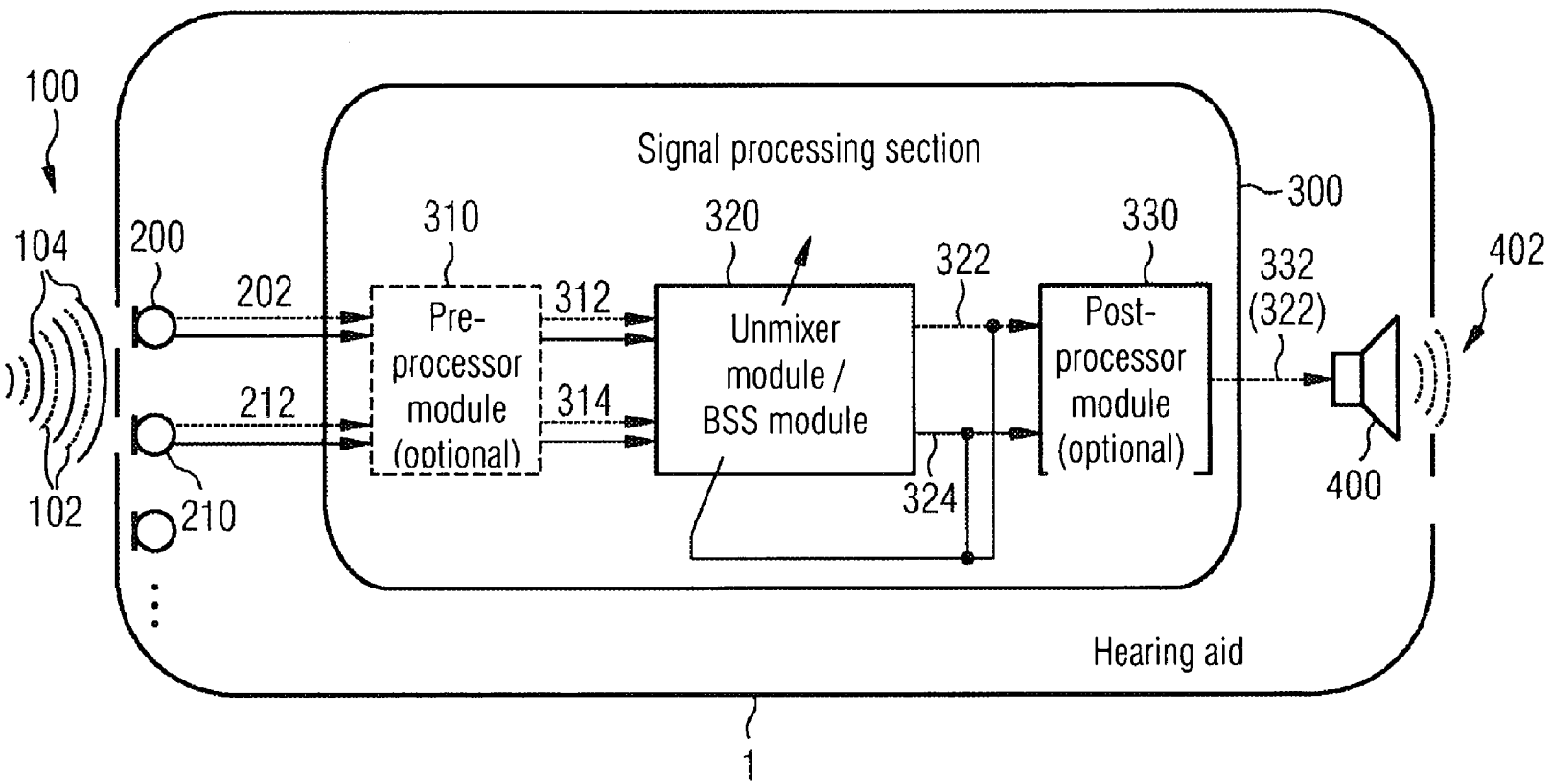
FIG. 2 shows a block diagram of a hearing aid according to the invention, having an inventive signal processing section for processing an ambient sound containing two acoustic sources that are acoustically independent of one another.

FIG. 2 now shows a first embodiment of the invention wherein a signal processing section 300 of the hearing aid 1 contains an unmixer module 320, hereinafter referred to as a BSS module 320, connected downstream of which is a post-processor module 330. A pre-processor module 310 which appropriately conditions i.e. prepares the input signals for the BSS module 320 can again be provided here. Signal processing 300 is preferably carried out in a DSP (Digital Signal Processor) or an ASIC (Application Specific Integrated Circuit).

It shall be assumed in the following that there are two mutually independent acoustic 102, 104, i.e. signal sources 102, 104, in the ambient sound 100. One of said acoustic sources 102 is a speech source 102 disposed close to the hearing aid wearer, also referred to as a local acoustic source 102. The other acoustic source 104 shall in this example likewise be a speech source 104, but one that is further away from the hearing aid wearer than the speech source 102. The speech source 102 is to be selected and tracked by the hearing aid 1 or more specifically the signal processing section 300 and is to be a main acoustic component of the receiver 400 so that an output sound 402 of the loudspeaker 400 mainly contains said signal (102).

The two microphones 200, 210 of the hearing aid 1 each pick up a mixture of the two acoustic signals 102, 104—indicated by the dotted arrow (representing the preferred acoustic signal 102) and by the continuous arrow (representing the non-preferred acoustic signal 104)—and deliver them either to the pre-processor module 310 or immediately to the BSS module 320 as electrical input signals. The two microphones 200, 210 can be arranged in any manner. They can be located in a single hearing device 1 of the hearing aid 1 or distributed over both hearing devices 1. It is also possible, for instance, to provide one or both microphones 200, 210 outside the hearing aid 1, e.g. on a collar or in a pin, so long as it is still possible to communicate with the hearing aid 1. This also means that the electrical input signals of the BSS module 320 do not necessarily have to originate from a single hearing device 1 of the hearing aid 1. It is, of course, possible to implement more than two microphones 200, 210 for a hearing aid 1. A hearing aid 1 consisting of two hearing devices 1 preferably has a total of four or six microphones.

The pre-processor module 310 conditions the data for the BSS module 320 which, depending on its capability, for its part forms two separate output signals from its two, in each case mixed input signals, each of said output signals representing one of the two acoustic signals 102, 104. The two separate output signals of the BSS module 320 are input signals for the post-processor module 330 in which it is then decided which of the two acoustic signals 102, 104 will be fed out to the loudspeaker 400 as an electrical output signal 332.

For this purpose (see also FIG. 3), the post-processor module 330 performs distance analysis of the electrical acoustic signals 322, 324, a spatial distance from the hearing aid 1 being determined for each of these electrical acoustic signals 322, 324. The post-processor module 330 then selects the electrical acoustic signal 322 having the shortest distance from the hearing aid 1 and delivers said electrical acoustic signal 322 to the loudspeaker 400 as an electrical output acoustic signal 332 (essentially corresponding to the electrical acoustic signal 322) in an amplified manner compared to the other electrical acoustic signal 324.

Figure 3:
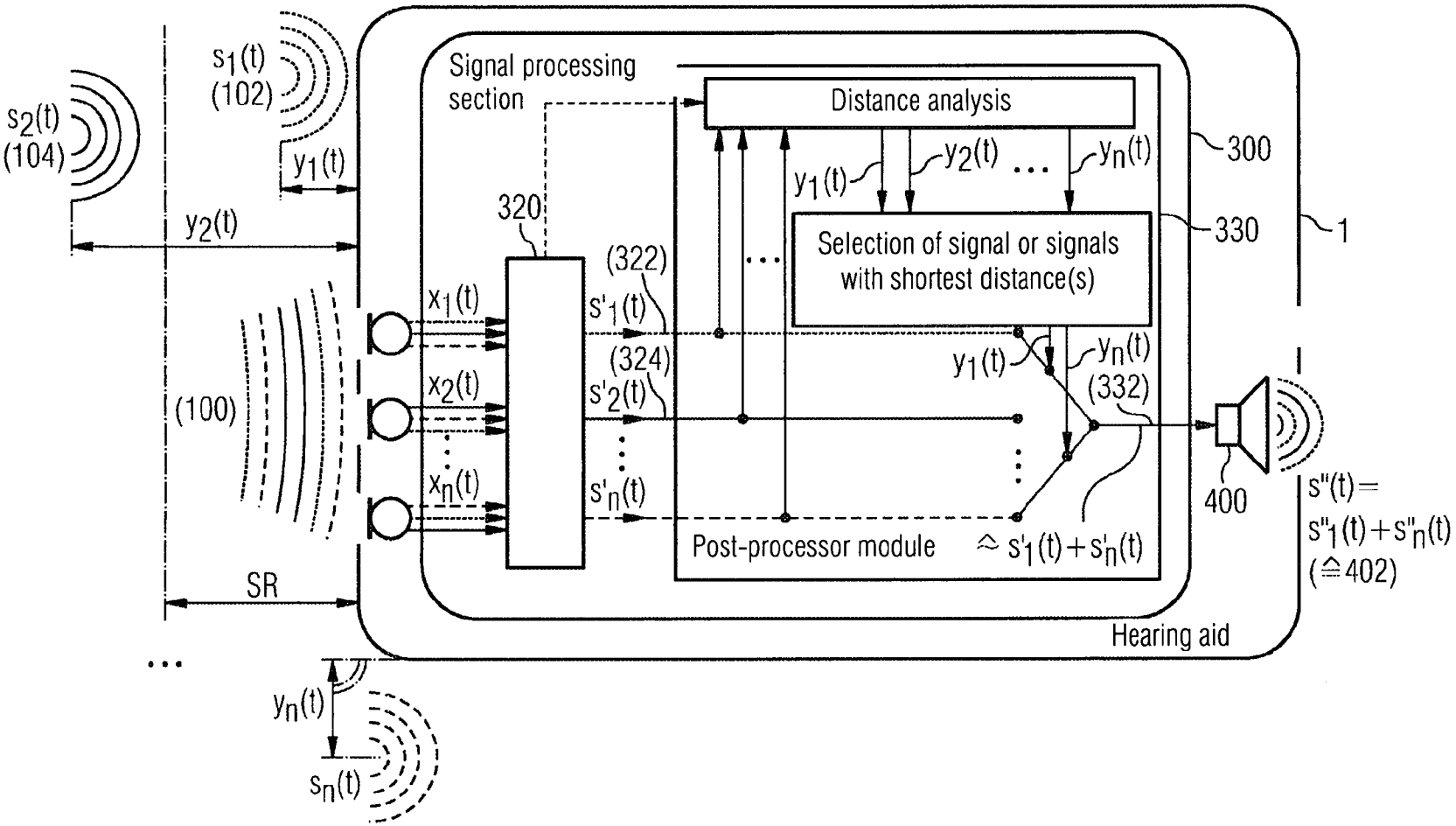
FIG. 3 shows a block diagram of a second embodiment of the inventive hearing aid for simultaneously processing three acoustically independent acoustic sources in the ambient sound.

FIG. 3 shows the inventive method and the inventive hearing aid 1 for processing three acoustic signal sources $s_1(t)$, $s_2(t)$, $s_n(t)$ which, in combination, constitute the ambient sound 100. Said ambient sound 100 is picked up in each case by three microphones which each feed out an electrical microphone signal $x_1(t)$, $x_2(t)$, $x_n(t)$ to the signal processing section 300. Although the signal processing section 300 has no pre-processor module 310, it can preferably contain one. (This applies analogously also to the first embodiment of the invention). It is, of course, also possible to process n acoustic sources s simultaneously via n microphones x, which is indicated by the dots ( . . . ) in FIG. 3.

The electrical microphone signals $x_1(t)$, $x_2(t)$, $x_n(t)$ are input signals for the BSS module 320 which separates the acoustic signals respectively contained in the electrical microphone signals $x_1(t)$, $x_2(t)$, $x_n(t)$ according to acoustic sources $s_1(t)$, $s_2(t)$, $s_n(t)$ and feeds them out as electrical output signals $s'_1(t)$, $s'_2(t)$, $s'_n(t)$ to the post-processor module 330.

In the following there are two speech sources $s_1(t)$, $s_n(t)$ in the vicinity of the hearing aid wearer, so that there is a high degree of probability that the hearing aid wearer is in a conversation situation with said two speech sources $s_1(t)$, $s_n(t)$. This is also indicated in FIG. 3 by the two speech sources $s_1(t)$, $s_n(t)$ being within a speech range SR, said speech range SR being designed to correspond to a sphere around the hearing aid wearer's head, within which normal conversation volumes obtain. Outside the speech range SR the corresponding volume level of a speech source $s_2(t)$ is too low to suppose that said speech source $s_2(t)$ is in a conversation situation with the hearing aid wearer. For a conversation situation, a front half of an equatorial layer of this sphere is preferred, said equatorial layer having a maximum height of approximately 1.5 m, preferably 0.8-1.2 m, more preferably 0.4-0.7 m and most preferably 0.2-0.4 m. The equator in whose plane the microphones of the hearing aid 1 approximately lie preferably runs in the center of the boundary of the equatorial layer. This may be different for comparatively tall or comparatively short hearing aid wearers, as the latter often converse with an interlocutor with a vertical offset in a particular direction. In other words, for a comparatively tall hearing aid wearer the equator is in an upper section of the equatorial layer, so that an attention range of the hearing aid 1 is directed downward rather than upward. In the case of a comparatively short hearing aid wearer, the opposite is true. This scenario is preferably suitable for a local region in which a maximum speech range of 2 to 3 m obtains. Also suitable for defining the speech range SR is a cylinder whose longitudinal axis coincides with a longitudinal axis of the hearing aid wearer. For other situations it makes more sense to define this equatorial layer via an aperture angle. Here an aperture angle can be 90-120°, preferably 60-90°, more preferably 45-60° and most preferably 30-45°. Such a scenario is preferably suitable for a more distant region.

Contained in the electrical acoustic signals $s'_1(t)$, $s'_2(t)$, $s'_n(t)$ generated by the BSS module 320, which correspond to the speech or more specifically acoustic sources $s_1(t)$, $s_2(t)$, $s_n(t)$, is distance information $y_1(t)$, $y_2(t)$, $y_n(t)$ which is indicative of how far the respective speech source $s_1(t)$, $s_2(t)$, $s_n(t)$ is away from the hearing aid 1 or more specifically the hearing aid wearer. The reading of this information in the form of distance analysis takes place in the post-processor module 330 which assigns distance information $y_1(t)$, $y_2(t)$, $y_n(t)$ of the acoustic source $s_1(t)$, $s_2(t)$, $s_n(t)$ to each electrical speech signal $s'_1(t)$, $s'_2(t)$, $s'_n(t)$ and then selects the electrical acoustic signal or signals $s_1(t)$, $s_n(t)$ for which it is probable, on the basis of the distance information, that the hearing aid wearer is in conversation with his/her speech sources $s_1(t)$, $s_n(t)$. This is illustrated in FIG. 3 in which the speech source $s_1(t)$ is located opposite the hearing aid wearer and the speech source $s_n(t)$ is disposed at an angle of approximately 90° to the hearing aid wearer, both of which are within the speech range SR.

The post-processor module 330 now delivers the two electrical acoustic signals $s'_1(t)$, $s'_n(t)$ to the loudspeaker 400 in an amplified manner. It is also conceivable, for example, for the acoustic source $s_2(t)$ to be a noise source and therefore to be ignored by the post-processor module 330, this being ascertainable by a corresponding module or more specifically a corresponding device in the post-processor module 330.

There are a large number of possibilities for ascertaining how far an acoustic source 102, 104; $s_1(t)$, $s_2(t)$, $s_n(t)$ is away from the hearing aid 1 or more specifically the hearing aid wearer, namely by evaluating the electrical representatives 322, 324; $s'_1(t)$, $s'_2(t)$, $s'_n(t)$ of the acoustic sources 102, 104; $s_1(t)$, $s_2(t)$, $s_n(t)$ accordingly.

For example, a ratio of a direct sound component to an echo component of the corresponding acoustic source 102, 104; $s_1(t)$, $s_2(t)$, $s_n(t)$ or more specifically the corresponding electrical signal 322, 324; $s'_1(t)$, $s'_2(t)$, $s'_n(t)$ can give an indication of the distance between the acoustic source 102, 104; $s_1(t)$, $s_2(t)$, $s_n(t)$ and the hearing aid wearer. That is to say, in the individual case, the larger the ratio, the closer the acoustic source 102, 104; $s_1(t)$, $s_2(t)$, $s_n(t)$ is to the hearing aid wearer. For this purpose, additional states which precede the decision as to local acoustic source 102; $s_1(t)$, $s_n(t)$ or other acoustic source 104; $s_2(t)$ can be analyzed within the source separation process. This is indicated by the dashed arrow from the BSS module 320 to the distance analysis section of the post-processor module 330.

In addition, a level criterion can indicate how far an acoustic source 102, 104; $s_1(t)$, $s_2(t)$, $s_n(t)$ is away from the hearing aid 1, i.e. the louder an acoustic source 102, 104; $s_1(t)$, $s_2(t)$, $s_n(t)$, the greater the probability that it is near the microphones 200, 210 of the hearing aid 1.

In addition, inferences can be drawn about the distance of an acoustic source 102, 104; $s_1(t)$, $s_2(t)$, $s_n(t)$ on the basis of a head shadow effect. This is due to differences in sound incident on the left and right ear or more specifically a left and right hearing device 1 of the hearing aid 1.

Source "punctiformity" likewise contains distance information. There exist methods allowing inferences to be drawn as to how "punctiform" (in contrast to "diffuse") the respective acoustic source 102, 104; $s_1(t)$, $s_2(t)$, $s_n(t)$ is. It generally holds true that the more punctiform the acoustic source, the closer it is to the microphone system of the hearing aid 1.

In addition, indications of a distance of the respective acoustic source 102, 104; s1(t), s2(t), sn(t) from the hearing aid 1 can be determined via time-related signal features. In other words, from the shape of the time signal, e.g. the edge steepness of an envelope curve, inferences can be drawn as to the distance away of the corresponding acoustic source 102, 104; s1(t), s2(t), sn(t).

Moreover, it is self-evidently also possible, by means of a plurality of microphones 200, 210, to determine the distance of the hearing aid wearer from an acoustic source 102, 104; $s_1(t)$, $s_2(t)$, $s_n(t)$ e.g. by triangulation.

In the second embodiment of the invention, it is self-evidently also possible to reproduce a single speech acoustic source or three or more speech acoustic sources $s_1(t)$, $s_n(t)$ in an amplified manner.

According to the invention, distance analysis can always be running in the background in the post-processor module 330 in the hearing aid 1 and be initiated when a suitable electrical speech signal 322; $s'_1(t)$, $s'_n(t)$ occurs. It is also possible for the inventive distance analysis to be invoked by the hearing aid wearer, i.e. establishment of "local source" mode of the hearing aid 1 can be initiated by an input device that can be called up or actuated by the hearing aid wearer. Here, the input device can be a control on the hearing aid 1 and/or a control on a remote control of the hearing aid 1, e.g. a button or switch (not shown in the Fig.). It is also possible for the input device to be implemented as a voice control unit with an assigned speaker recognition module which can be matched to the hearing aid wearer's voice, the input device being implemented at least partly in the hearing aid 1 and/or at least partly in a remote control of the hearing aid 1.

Moreover, it is possible by means of the hearing aid 1 to obtain additional information as to which of the electrical speech signals 322; $s'_1(t)$, $s'_n(t)$ are preferably reproduced to the hearing aid wearer as output sound 402, s" (t). This can be the angle of incidence of the corresponding acoustic source 102, 104; $s_1(t)$, $s_2(t)$, $s_n(t)$ on the hearing aid 1, particular angles of incidence being preferred. For example, the 0 to ±10° viewing direction (interlocutor sitting directly opposite) and/or a ±70 to ±100° lateral direction (interlocutor right/left) and/or a ±20 to ±45° viewing direction (interlocutor sitting obliquely opposite) of the hearing aid wearer may be preferred. It is also possible to weight the electrical speech signals 322; $s'_1(t)$, $s'_n(t)$ as to whether one of the electrical speech signal 322; $s'_1(t)$, $s'_n(t)$ is a predominant and/or a comparatively loud electrical speech signal 322; $s'_1(t)$, $s'_n(t)$ and/or contains (a known) spoken language.

According to the invention it is not necessary for distance analysis of the electrical acoustic signals 322; 324; $s'_1(t)$, $s'_2(t)$, $s'_n(t)$ to be performed inside the post-processor module 330. It is likewise possible, e.g. for reasons of speed, for distance analysis to be carried out by another module of the hearing aid 1 and only the selecting of the electrical acoustic signal(s) 322, 324; $s'_1(t)$, $s'_2(t)$, $s'_n(t)$ with the shortest distance information to be left to the post-processor module 330. For such an embodiment of the invention, said other module of the hearing aid 1 shall by definition be incorporated in the post-processor module 330, i.e. in an embodiment of this kind the post-processor module 330 contains this other module.

The present specification relates inter alia to a post-processor module 20 as in EP 1 017 253 A2 (the reference numerals are those given in EP 1 017 253 A2), in which module one or more speakers/acoustic sources is/are selected for an electrical output signal of the post-processor module 20 by means of distance analysis and reproduced therein in at least amplified form, as to which see also paragraph [0025] in EP 1 017 253 A2. In the invention, the pre-processor module and the BSS module can also be structured in the same way as the pre-processor 16 and the unmixer 18 in EP 1 017 253 A2, as to which see in particular paragraphs [0008] to [0024] in EP 1 017 253 A2.

The invention also links to EP 1 655 998 A2 in order to provide stereo speech signals or rather enable a hearing aid wearer to be supplied with speech in a binaural acoustic manner, the invention (notation according to EP 1 655 998 A2) preferably being connected downstream of the output signals z1, z2 for the right(k) and left(k) respectively of a second filter device in EP 1 655 998 A2 (see FIGS. 2 and 3) for accentuating/amplifying the corresponding acoustic source. In addition, it is also possible to apply the invention in the case of EP 1 655 998 A2 to the effect that it will come into play after the blind source separation disclosed therein and ahead of the second filter device, i.e. selection of a signal y1(k), y2(k) inventively taking place (see FIG. 3 in EP 1 655 998 A2).

The invention claimed is:

1. A method for operating a hearing aid, comprising:

receiving ambient sound from acoustic sources at ambient signal receiving locations;

generating electrical acoustic signals by the hearing aid from the ambient sound;

separating the electrical acoustic signals into electrical output signals by a signal processing section of the hearing aid;

establishing a local source operating mode by the signal processing section;

selecting a first acoustic source from the separated electrical output signals in the local source operating mode, wherein the first acoustic source is selected based on a criteria that is selected from the group consisting of: a ratio of direct sound to an echo component, a level criterion, a head shadow effect, punctiformity of a respective source, a time feature, a freedom from interference, a vertical distance from the hearing aid wearer, and a spoken language; and outputting the first acoustic source in an output sound of the hearing aid so that the first acoustic source is acoustically prominent and better perceived for a hearing aid wearer compared to other acoustic sources.

2. The method as claimed in claim 1, wherein the first acoustic source is located within a speaker's speech range with respect to the hearing aid wearer within which a spoken language is understood.

3. The method as claimed in claim 1, wherein the other acoustic sources are located spatially further away than the first acoustic source with respect to the hearing aid wearer.

4. The method as claimed in claim 1, wherein the ambient sound comprises a plurality of local acoustic sources that are acoustically independent of one another and are tracked separately from one another.

5. The method as claimed in claim 1, wherein a distance analysis of the electrical acoustic signals is performed by the signal processing section for determining a distance from the hearing aid wearer for each of the acoustic sources.

6. The method as claimed in claim 5, wherein the first acoustic source is selected based on a criteria having a shortest distance from the hearing aid wearer.

7. The method as claimed in claim 1, wherein the first acoustic source contains speech or is not excessively disturbed by an interference signal.

8. The method as claimed in claim 1, wherein the signal processing section comprises an unmixer module for separating the electrical acoustic signals and a post-processor module for establishing the local source operating mode.

9. The method as claimed in claim 8, wherein the unmixer module is a blind source separation module.

10. The method as claimed in claim 8, wherein a volume of the electrical acoustic signals is adjusted in the post-processor module.

11. The method as claimed in claim 8, wherein the signal processing section comprises a pre-processor module for conditioning the electrical acoustic signals for the unmixer module.

12. The method as claimed in claim 1, wherein the first acoustic source comes from a particular direction with respect to the hearing aid wearer and is tracked by the signal processing section, and wherein the particular direction is a 0° viewing direction or a 90° lateral direction with respect to the hearing aid wearer.

13. The method as claimed in claim 1, wherein the first acoustic source is predominant in the ambient sound and is tracked in the local source mode.

14. The method as claimed in claim 1, wherein only the first acoustic source from the ambient sound is perceived by the hearing aid wearer in the output sound of the hearing aid in the local source mode.

15. A method for operating a hearing aid, comprising:

receiving ambient sound from acoustic sources at ambient signal receiving locations;

generating electrical acoustic signals by the hearing aid from the ambient sound;

separating the electrical acoustic signals into electrical output signals by a signal processing section of the hearing aid;

establishing a local source operating mode by the signal processing section, wherein a distance analysis of the electrical acoustic signals is performed by the signal processing section for determining a distance from a wearer of the hearing aid for each of the acoustic sources without regard for a distance between the ambient signal receiving locations;

selecting a first acoustic source from the separated electrical output signals in the local source operating mode, wherein the first acoustic source is selected based on a distance from the wearer of the hearing aid; and outputting the first acoustic source in an output sound of the hearing aid so that the first acoustic source is acoustically prominent and better perceived for a hearing aid wearer compared to other acoustic sources.

16. A hearing aid, comprising:

a microphone that generates electrical acoustic signals from acoustic sources in an ambient sound; and a signal processing section that:

separates the electrical acoustic signals into electrical output signals by an unmixer module, establishes a local source operating mode by a post-processor module, selects a first acoustic source from the separated electrical output signals in the local source operating mode, wherein the first acoustic source is selected based on a criteria that is selected from the group consisting of: a ratio of direct sound to an echo component, a level criterion a head shadow effect, punctiformity of a respective source a time feature a freedom from interference, a vertical distance from the hearing aid wearer, and a spoken language, and outputs the first acoustic source in an output sound of the hearing aid so that the first acoustic source is acoustically prominent and better perceived for a hearing aid wearer compared to other acoustic sources.

17. The hearing aid as claimed in claim 16, wherein the post-processor module tracks and selects the first acoustic source and generates a corresponding electrical output signal in the output sound for a loudspeaker of the hearing aid.

18. The hearing aid as claimed in claim 16, wherein the hearing aid comprises a plurality of microphones that receive the ambient sound and feed the electrical acoustic signals to the signal processing section.

19. The hearing aid as claimed in claim 16, wherein the hearing aid comprises a single hearing device or two hearing devices.

* * * * *